US006555796B1

(12) United States Patent
Cusack

(10) Patent No.: US 6,555,796 B1
(45) Date of Patent: Apr. 29, 2003

(54) HEATER HAVING OVER TEMPERATURE CONTROL

(75) Inventor: Jon B. Cusack, Holland, MI (US)

(73) Assignee: Sherwood-Templeton Coal Company, Inc., Terre Haute, IN (US)

( * ) Notice: Subject to any disclaimer, the term of this patent is extended or adjusted under 35 U.S.C. 154(b) by 0 days.

(21) Appl. No.: 10/053,181

(22) Filed: Nov. 13, 2001

(51) Int. Cl.[7] ..... H05B 1/02

(52) U.S. Cl. ..... 219/481; 219/508; 219/497; 219/512; 392/485; 392/488

(58) Field of Search ..... 219/508, 507, 219/512, 481, 497, 501, 506, 505; 392/449, 488, 485, 490–495, 451

(56) References Cited

U.S. PATENT DOCUMENTS 4,593,177 A * 6/1986 Trostler ..... 219/494
5,555,725 A * 9/1996 Shimansaki et al. ..... 219/202
5,731,570 A * 3/1998 Aoki ..... 219/497
5,982,987 A * 11/1999 McDonald et al. ..... 392/449
6,080,973 A 6/2000 Thweatt, Jr. ..... 219/497
6,389,226 B1 * 5/2002 Neale et al. ..... 392/485

* cited by examiner

*Primary Examiner*—Mark Paschall
(74) *Attorney, Agent, or Firm*—Price, Heneveld, Cooper, DeWitt & Litton

(57) ABSTRACT

A heater having a shut off device is provided which prevents false over temperature lockouts. The heater comprises a body having walls defining a volume for holding water, a heating element thermally coupled to the body for heating water within the body, and a temperature sensor for sensing temperature of the material. The heater also has a shut off switch for shutting off electric current in the heater when the sensed temperature of the water exceeds a predetermined maximum temperature limit, and a manually actuated reset input for resetting the shut off switch to allow current to be applied to the heater. The heater further includes a controller coupled to the shut off switch and the reset switch, wherein the controller determines the presence of a false over temperature event and overrides the need to manually actuate the reset input.

25 Claims, 5 Drawing Sheets

HEATER HAVING OVER TEMPERATURE CONTROL

BACKGROUND OF THE INVENTION

The present invention generally relates to electric heaters and, more particularly, to heaters, such as electric water heaters, employing over temperature shut off controls.

Electrically powered water heaters are commonly employed to heat a supply of water for use in jetted bathtubs, spas/hot tubs and other heated water applications by heating water flowing through a vessel. Electric water heaters typically include an electric powered heating element arranged in a heat transfer relationship with the water flowing within the vessel. In many conventional flow-through water heating systems, a thermostat is disposed within the hollow of the vessel or the tub to sense the temperature of the water, and the heating element is generally controlled based on the sensed water temperature so as to maintain a desired water temperature. One example of a water heater is disclosed in U.S. Pat. No. 6,080,973, the disclosure of which is hereby incorporated by reference.

Conventional electric water heaters employed in jetted bathtubs and spas/hot tubs are generally controlled in response to the sensed water temperature to maintain a user selectable water temperature in the heated water tub. In most jetted bathtubs, a maximum upper temperature limit of about 104° F. is typically established according to industry standards. In addition to controlling the heating element to achieve the selected water temperature, it is also desirable to ensure adequate operation of the water heater to prevent an excessive over temperature condition (i.e., overheating) and problems that can arise therefrom. For example, in the event that a failure occurs in the heater controls, the water temperature may exceed the maximum upper temperature limit. The water heater may overheat quickly when there is an inadequate amount of water present in the heater vessel due to an abnormally low water level. Advanced overheating may also occur when there is inadequate water flow through the heater vessel such as may be caused by the failure of a water pump or other water flow restriction.

In order to prevent the presence of an excessive over temperature condition, many conventional water heaters are generally equipped with a temperature actuated shut off device that discontinues power supplied to the heating element when a predetermined upper temperature limit is reached. Conventional temperature-based shut off devices include a snap disc thermal switch connected in series with the power input of the electrically operated heating element. The snap disc thermal switch is designed to switch from a closed position to an open position to open circuit the power line supplying electric current to the heating element upon detecting a predetermined upper temperature limit of about 117° F., according to one example. Some industries, such as the jetted bath tub and spa/hot tub industry, have established a requirement to also equip the water heater with a manually depressible reset button, and further require that a user must depress the reset button to reset the heater in order to allow the heater to be energized following an over temperature shut off. Typically, the reset button is located remote from the heated water tub, and thus requires that the user take additional action to reset the heater.

While it is desirable to equip heaters with over temperature shut off protection, there exist certain conditions where a false over temperature determination may occur. For example, if a user fills a spa/hot tub with excessively hot water having an elevated temperature above the upper temperature limit, the snap disc thermal switch may be tripped which, in turn, locks out (shuts off) use of the heater prior to the heater being energized, thus requiring that the user manually depress the reset button to reactivate and allow the heater to subsequently be energized. Therefore, it is desirable to provide for a heater control system that provides over temperature protection and yet reduces or minimizes the presence of false over temperature heater lockout events.

SUMMARY OF THE INVENTION

In accordance with the present invention, a heater having a shut off device is provided which prevents false over temperature lockouts. According to one aspect of the present invention, the heater comprises a body having walls defining a volume for holding material, a heating element thermally coupled to the body for heating material within the body, and a temperature sensor for sensing temperature of the material. The heater also has a shut off switch for shutting off the heater when the sensed temperature of the material exceeds a predetermined maximum temperature limit, and a manually actuated reset input for generating a reset signal to allow the heater to be turned on. The heater further includes a controller coupled to the shut off switch and the reset switch, wherein the heater is required to be reset by the reset input when an over temperature event is determined, and wherein the controller determines the presence of a false over temperature event and overrides the need to reset the heater during the false over temperature event.

According to another aspect of the present invention, a heater having a temperature sensitive shut off switch is provided. The heater includes a body having walls defining a volume for holding water to be heated, and an electric heating element thermally coupled to the body for heating water within the body. The heater also has a temperature sensitive switch, such as a snap disc thermal switch, connected in series with the heating element for sensing temperature of the water and shutting off electrical power supplied to the heating element when the sensed temperature of the water exceeds a predetermined maximum temperature limit. The heater further includes a controller connected to the temperature sensitive switch for monitoring voltage potential applied to the temperature sensitive switch and determining whether a failure of the heater has occurred as a function of the monitored voltage potential.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
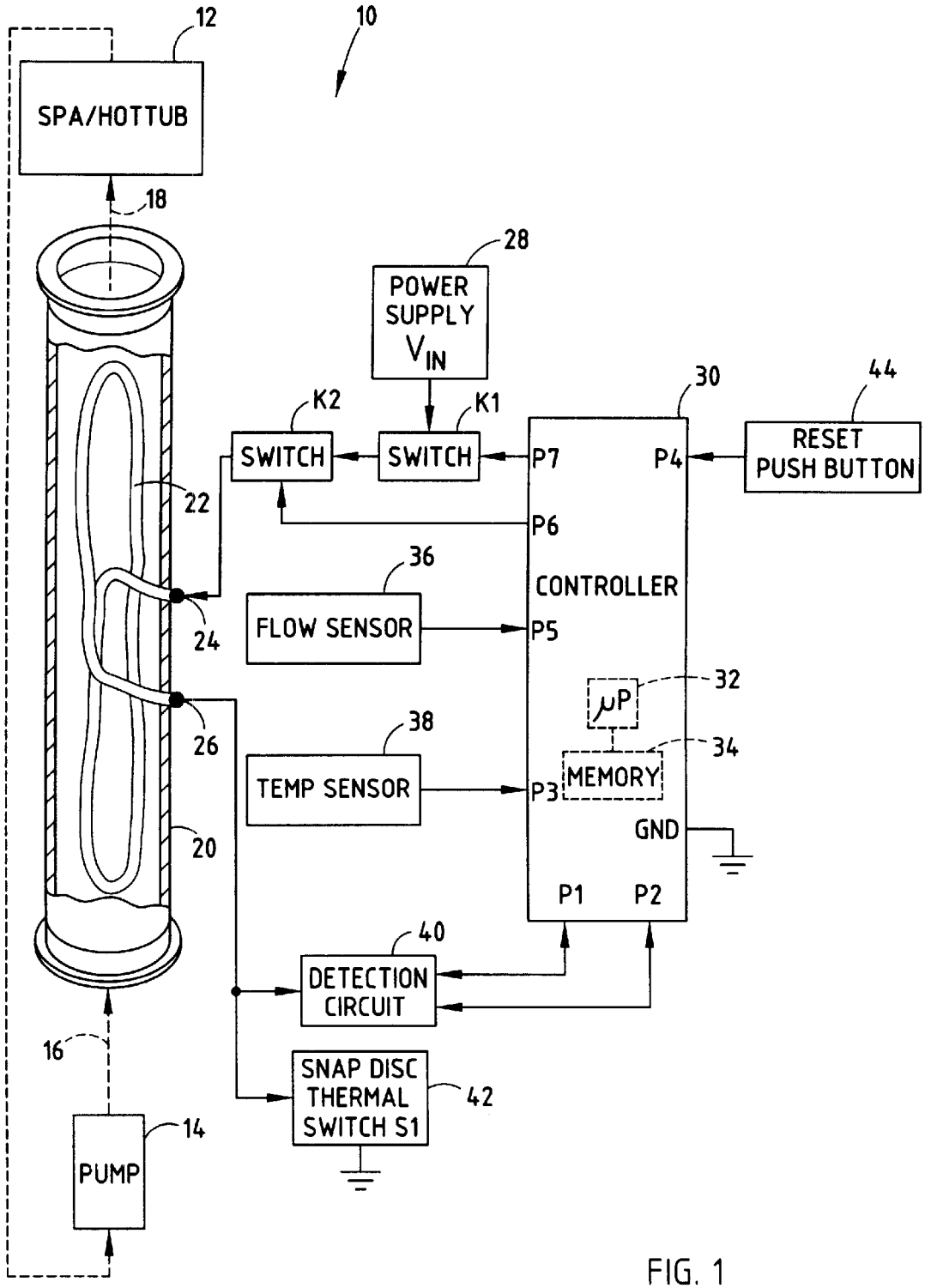
FIG. 1 is a block diagram illustrating an electric water heater in cross section and a heater control system according to the present invention.

Referring to FIG. 1, an electric water heater 10 having a heater control system according to the present invention is generally illustrated for heating water for use in a heated water tub, such as a spa/hot tub 12 or a jetted bathtub. The heater 10 shown and described herein is a flow-through water heater in which water from the tub 12 is circulated in a known manner by way of a pump 14 into the inlet 16 of water heater 10. During normal heating operation, the circulating water is heated in the heater 10 as it flows past an electric heating element 22. The heated water then flows out of outlet 18 and is circulated back into the tub 12. While the water heater 10 is illustrated and described herein as a flow-through water heater for use in heating water in a spa/hot tub 12 or jetted bathtub, it should be appreciated that the heater 10 may alternately include different types of heaters configured in various shapes and sizes and may be used in various other applications to heat various materials.

The heater 10 shown generally includes a body in the form of a hollow vessel 20 having cylindrical walls defining a volume for holding water or other material to be heated when the heater 10 is energized. The vessel 20 may be made of stainless steel or polymeric material, such as polyvinyl chloride (PVC), for example. An electrical heating element 22 is thermally coupled to the vessel 20 for transferring thermal energy to the water to heat the water within the vessel 20. The heating element 22 may be disposed within vessel 20 and in direct contact with the water as shown. Alternately, heating element 22 may be disposed on the outer walls of a heat conductive vessel 20 for indirectly heating the water by heat conduction through vessel 20.

The heating element 22 has an input terminal 24 and an output terminal 26 extending through a pair of openings in the walls of vessel 20. The input terminal 24 is connected to a power supply that supplies an electric voltage input $V_{IN}$. The output terminal 26 is connected in series to a snap disc thermal switch (S1) 42 which, in turn, is coupled to ground. Also coupled to the output terminal 26 is a detection circuit 40 which detects the voltage potential at the output terminal 26. The detection circuit 40 further detects the state (i.e., open or closed positions) of the snap disc thermal switch 42 as described herein.

The heater 10 also employs a flow sensor 36 and a temperature sensor 38. The flow sensor 36 senses water flow within the heater vessel 20 and produces a flow signal indicative thereof. The flow signal is processed and used to determine if insufficient water flow is present, such that the heater should be shut off to prevent overheating. The temperature sensor 38 senses temperature of the water within the vessel 20 and produces a temperature signal indicative thereof. The temperature signal is processed and used to determine the amount of heating required to achieve a set water temperature.

The heater 10 further includes a controller 30 having a microprocessor 32 and memory 34. The controller 30 described herein is a digital controller programmed to process control routines that are stored in memory 34 and performed by microprocessor 32 for controlling the operation of the heater 10. The controller has input/output pins P1–P8. Controller inputs include the flow signal at pin P5, the temperature signal at P3, and a reset signal at pin P4 generated by a reset pushbutton 44. The controller 30 is also connected to the detection circuit 40 via pins P1 and P2 for receiving the sensed voltage at output terminal 26 and further performing a routine to detect a shut off condition and set the lockout flag. The controller 30 also controls the input voltage $V_{IN}$ from power supply 28 applied to heating element 22 by controlling switches K1 and K2 via pins P6 and P7 by keeping closed both of normally open switches K1 and K2 to apply voltage $V_{IN}$ and allow current flow in the heating element 22, and further open circuiting one or both of switches K1 and K2 to cut off power supplied to heating element 22. The controller 30 controls both of switches K1 and K2 so as to turn off the heating element 22 during certain detected conditions. Based on certain detected conditions, the controller 30 provides a shut off to de-energize the heating element 22. While a digital controller 30 is shown and described herein, it should be appreciated that the controller could otherwise include analog circuitry.

Figure 2:
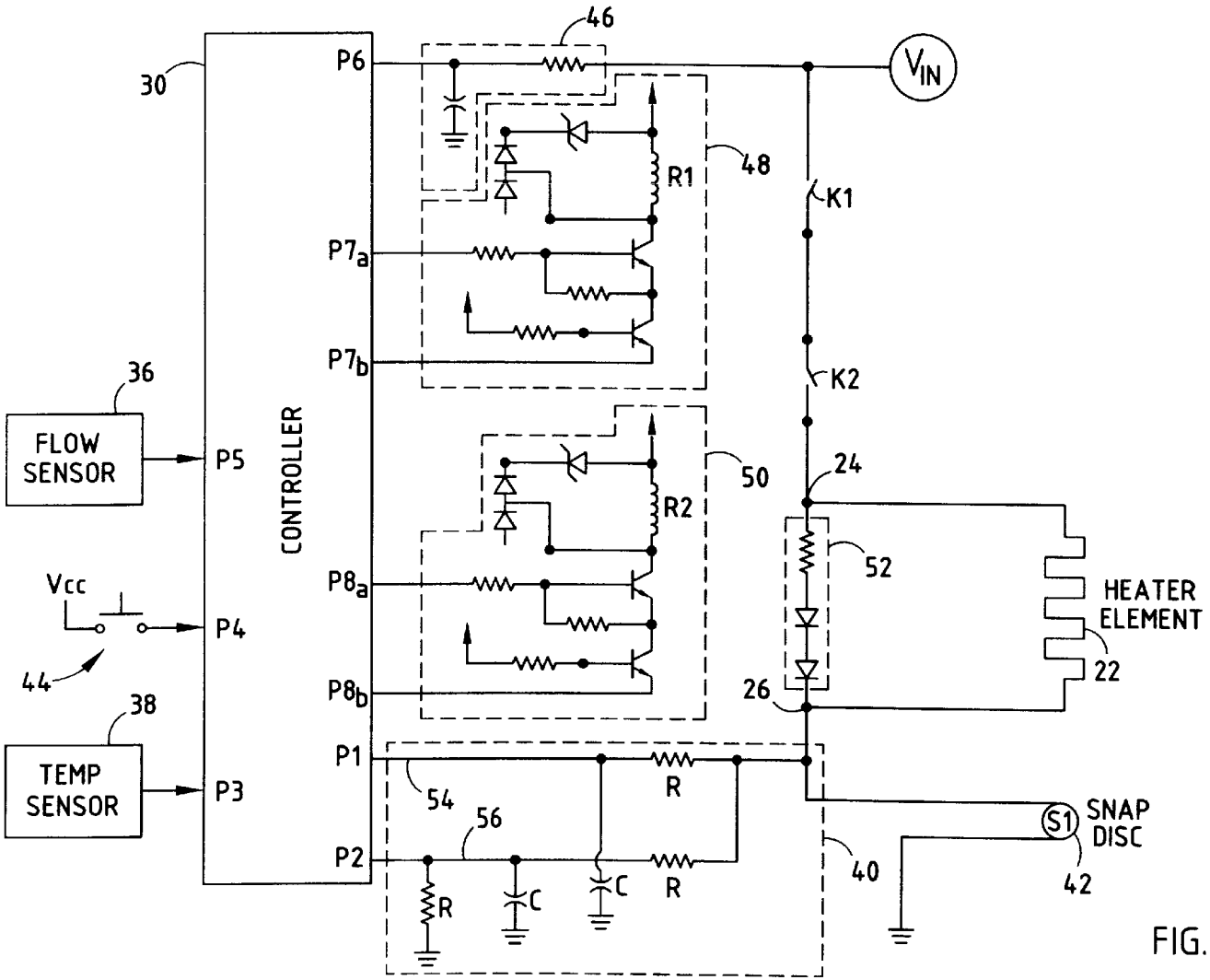
FIG. 2 is a block/circuit diagram further illustrating the electric water heater control system for controlling the heater according to the present invention.

Referring particularly to FIG. 2, the pair of switches K1 and K2 are shown as relay controlled switches K1 and K2 connected in series to the input terminal 24 of heating element 22. Switch K1 is controlled in response to relay R1 of a regulating relay drive circuit 48. The regulating relay drive circuit 48 includes a pair of inputs coupled to pins $P7_a$ and $P7_b$ of controller 30. In response to detecting certain conditions, controller 30 turns off relay R1 of regulating relay drive circuit 48 to cause switch K1 to switch from a closed position to an open position, thereby shutting off power to heating element 22. Switch K2 is controlled in response to relay R2 of the limit relay drive circuit 50. Limit relay drive circuit 50 likewise includes a pair of inputs coupled to pins $P8_a$ and $P8_b$ of controller 30. Controller 30 turns off relay R2 of limit relay drive circuit 50 so as to cause switch K2 to switch from a closed position to an open position to thereby shut off power to the heating element 22. Switches K1 and K2 are in a closed position during normal heater control, thus allowing the heating element 22 to be energized. Switch K1 changes state from a closed position to an open circuit position whenever one of the following conditions is detected; the sensed temperature of the water exceeds a temperature limit of 104° F.; the snap disc thermo switch is open; insufficient water flow is detected, the reset button is depressed and not released; or a lockout event has occurred. Accordingly, switch K1 turns off power to the heating element 22 whenever one of the aforementioned events occurs. Switch K2 serves as a backup control switch that performs a redundancy check of certain conditions used to control switch K1. Switch K2 changes state from a closed position to an open circuit position whenever one of the following conditions is detected: insufficient water flow is detected; the reset button is depressed and not released; or a lockout event has occurred. Accordingly, switch K2 duplicates some of the function performed by switch K1 to turn off power to the heating element 22 whenever such events are detected.

The snap disc thermal switch S1 is a temperature sensitive switch that is in either an open circuit position or a closed circuit position depending on temperature. Snap disc thermal switches are well-known to those skilled in the art. One example of commercially available snap disc thermal switch includes Series No. Thermodisc 36T, commercially available from Thermodisc Inc. The aforementioned snap disc thermal switch is designed to change state from a closed position to an open circuit position whenever the temperature of the snap disc exceeds a predetermined temperature of about 117° F., and is further designed to reclose to the closed position when the temperature subsequently drops below a temperature of about 102° F. Sensors of this type generally have a tolerance of about ±4.5° F. Accordingly, the snap disc thermal switch S1 de-energizes current flow through the heating element 22 when the temperature rises above a temperature of about 117° F., ±4.5° F. and keeps the heating element 22 shut off until the temperature drops to below 102° F., ±4.5° F. When the temperature exceeds an upper temperature limit of 117° F. sufficient to open circuit the snap disc thermal switch S1, the heater control requires a manual reset of the control circuit when an actual over temperature condition occurs prior to re-energizing the heating element 22, but detects an event which provides a false over temperature indication, and thereby avoids the need for the manual reset.

To provide the manual reset, the heater 10 is further equipped with reset pushbutton 44 which is depressible by a user to reset the heater 10 following an over temperature shut off. The reset pushbutton 44 includes a contact for close circuiting an input to controller 30 via pin P4 to produce a reset signal. The controller 30 checks for both a closing of the reset pushbutton 44 followed by the release of the pushbutton 44 prior to acknowledging a reset event. By requiring both closing and release of the reset pushbutton 44, the controller 30 ignores the reset signal until release is detected to prevent users from keeping the reset pushbutton 44 fully depressed in an attempt to by pass the reset function. One example of a reset pushbutton 44 may include a miniature mechanical key switch having Part No. B3F-1052, commercially available from Omron Electronics.

Also shown in FIG. 2 is an AC reference circuit 46 which continuously checks for the presence of an AC line (e.g., 120 volts A.C.) supplied by voltage $V_{IN}$. If controller 30 determines that an AC line has not been detected for three continuous cycles, the controller 30 determines that a faulty control signal is present, and shuts down the heater control system by opening one or both of switches K1 and K2. Coupled in parallel to the heater element 22 is an indicator light 52 which provides a visual indication when the heating element 22 is energized.

The detection circuit 40 is connected to the output terminal 26 of heater element 22 and one end of snap disc thermal switch 42 via a pair of high impedance lines 54 and 56. The detection circuit 40 is further coupled to controller 30 via pins P1 and P2. The detection circuit 40 includes high impedance resistors R in each of high impedance lines 54 and 56. The other end of snap disc thermal switch 42 is connected to a ground reference common with the ground reference employed by the controller 30 and associated circuitry. In addition, each of the high impedance lines 54 and 56 has a capacitor C coupled to ground. High impedance line 56 further has a resistor R coupled to ground. High impedance line 54 is coupled to input pin P1 of controller 30, while high impedance line 56 is coupled to input line P2 of controller 30. The ground connections employed by detection circuit 40 are common to the ground connected to one end of snap disc thermal switch 42. The controller 30 applies a signal to one of the pins P1 or P2 and receives a signal on the other of pins P1 and P2, to detect whether the snap disc thermal switch S1 is open as described herein. By applying a voltage signal on one of the high impedance lines 54 and 56, via pins P1 or P2, respectively, the voltage signal on the other of the high impedance lines 54 and 56 may be sensed. If the snap disc is closed, the sensed signal received by one of pin P1 or P2 will be substantially the same as ground. Whereas if the snap disc 42 is open, the voltage potential received at the other of pin P1 or P2 will have a higher voltage potential.

Figure 3:
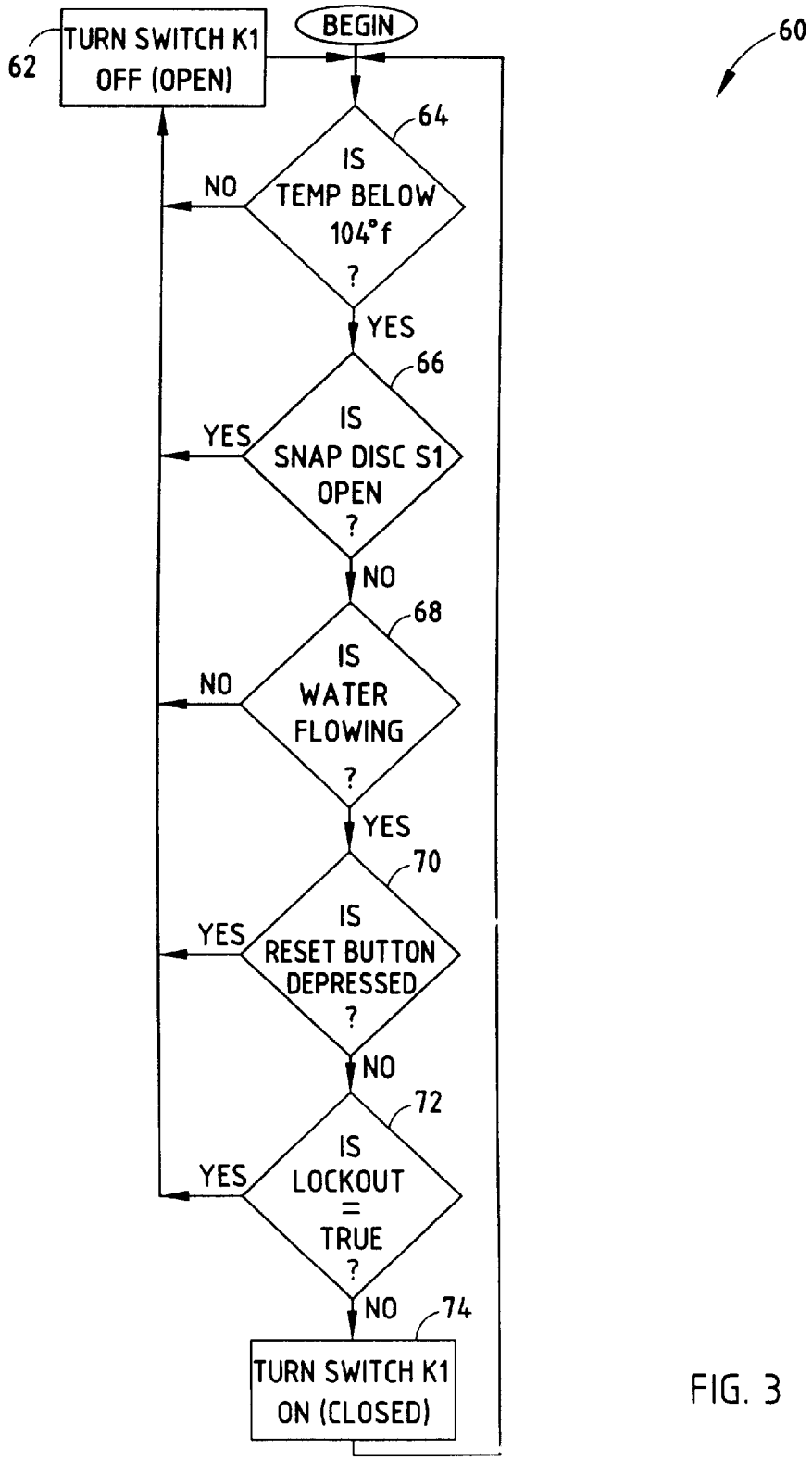
FIG. 3 is a flow diagram illustrating a methodology of controlling the heater by controlling switch K1 according to the present invention.

Referring to FIG. 3, a method 60 of controlling switch K1 to control power supplied to the heating element 22 is described therein. Methodology 60 checks for a number of conditions to determine whether to open or close switch K1. Included is decision step 64 for determining if the sensed water temperature is below an upper temperature limit of 104° F. and, if not, methodology 60 proceeds to turn switch K1 off to open circuit the power supplied to heating element 22. In decision step 66, methodology 60 determines if the snap disc thermal switch S1 is opened and, if so, turns switch K1 off (open). Otherwise, methodology 60 proceeds to decision step 68 to check if water is flowing and, if not, turns switch K1 off in step 62. Otherwise, methodology 60 proceeds to decision step 70 to determine if the reset button is depressed and has not been released and, if so, proceeds back to step 62 to turn switch K1 off. Otherwise, methodology 70 proceeds to decision step 72 to check if the lockout flag (e.g., bit) is set equal to true and, if so, turns switch K1 off in step 66. Otherwise, methodology 60 proceeds to step 74 to turn switch K1 on to thereby close the power supply circuit and allow heating element 22 to be energized. Thereafter, methodology 60 returns to decision step 64. Accordingly, if the temperature is below the upper temperature limit of 104° F., the snap disc thermal switch S1 is not open, water is flowing, the reset button is not depressed without being released, and the lockout flag is set equal to false, switch K1 is turned on (closed).

Figure 4:
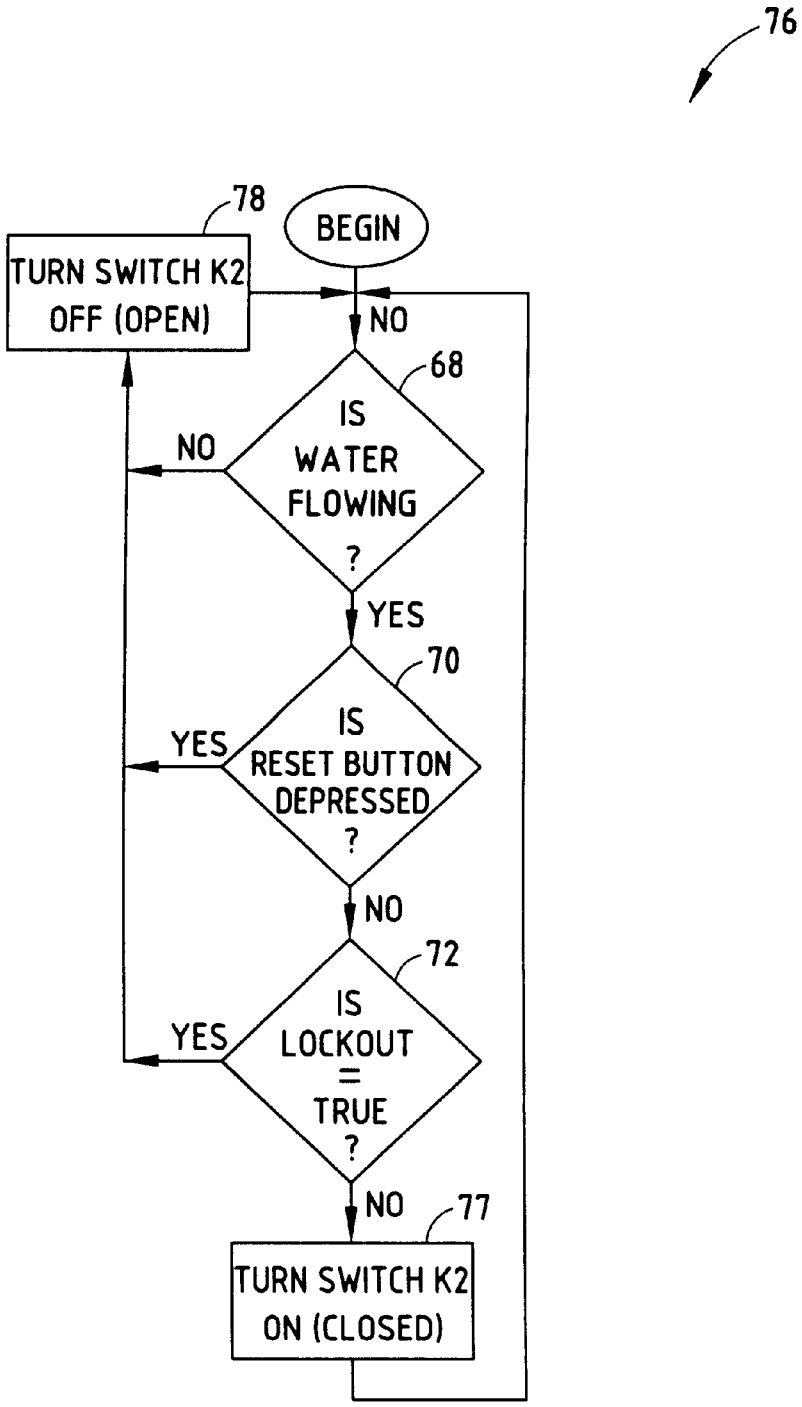
FIG. 4 is a flow diagram illustrating a methodology of further controlling the heater by controlling switch K2.

A methodology 76 for controlling switch K2 to open circuit or close circuit power supplied to heating element 22 is illustrated in FIG. 4. Methodology 76 likewise includes decision steps 68, 70, and 72 which check for whether water is flowing, the reset button is depressed without being released, and a lockout event has occurred, respectively. If water is not flowing, the reset button is depressed and has not been released, or if a lockout event has been detected, methodology 76 proceeds to step 78 to turn switch K2 off (open) to thereby open circuit the power supply to heating element 22. Otherwise, if water is flowing, the reset button is not depressed and released, and no lockout event is detected, methodology 76 proceeds to step 77 to turn switch K2 on (closed) to thereby close the power supply circuit and allow heating element 22 to be energized. Accordingly, methodology 76 controls switch K2 to perform duplicative functions similar to those performed by switch K1, thus serving as a backup control in the event that a relay or switch failure occurs.

Figure 5:
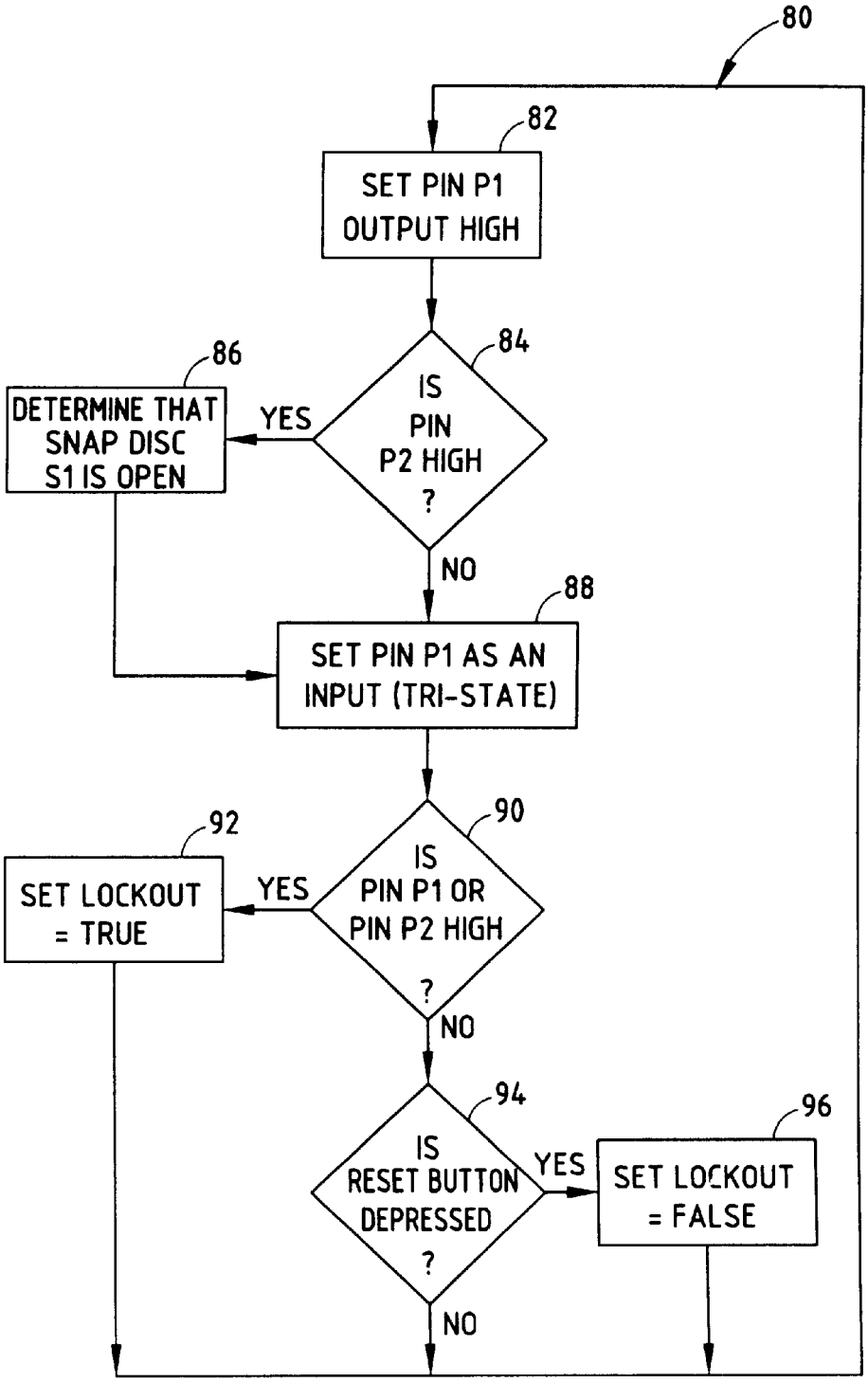
FIG. 5 is a flow diagram illustrating a methodology of detecting an over temperature lockout condition for use in controlling the heater.

Referring to FIG. 5, a methodology 80 of detecting a lockout condition and setting the lockout flag is illustrated therein. Methodology 80 includes step 82 of setting pin P1 output high. Next, in decision step 84, methodology 80 determines if pin P2 is set high and, if so, determines that the snap disc thermal switch S1 is open in step 86. In step 88, pin P1 is set as an input, and then in decision step 90, methodology 80 checks whether pin P1 or pin P2 is set high and, if so, sets the lockout flag equal to true in step 92, and then returns to step 82. Otherwise, methodology 80 proceeds to decision step 94 to check if the reset button is depressed and has not been released and, if not, returns to step 82. If the reset button has been depressed and has not yet been released, methodology 80 proceeds to step 96 to set the lockout flag equal to false. Accordingly, by setting the lockout flag equal to true in step 92, a lockout event is determined, whereas by setting the lockout flag equal to false in step 96, no such lockout event is determined. When the lockout flag is set equal to true, the controller 30 prevents the heater from being energized until the manual reset event occurs. As long as the lockout flag is set equal to false, the requirement for a manual reset is overridden by controller 30, and thus the heating element 22 may be energized. Thus, with the lockout flag set equal to false, closing of the snap disc combined with a sensed temperature of less than the preset upper temperature limit, will cause the controller 30 to turn on the relays R1 and R2 to close switches K1 and K2 to allow current to flow through heating element 22.

Accordingly, the heater 10 of the present invention advantageously detects the state of the snap disc thermal switch 42 and determines the presence of an over temperature condition. If a failure occurs in the control system, the resulting over temperature condition will be detected and a manual reset by the user will be required. If the over temperature condition is a false over temperature condition, the need for a manual reset is overridden. For example, if the heated water tub is filled with water having a temperature exceeding the upper maximum over temperature limit sufficient to open the snap disc thermal switch 42 and at least one of the switches K1 and K2 are open, when the water temperature drops sufficiently low enough to reclose the snap disc thermal switch 42, normal control of the heater 10 may be resumed without requiring actuation of the manual reset pushbutton 44.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A heater having a temperature shut off device, said heater comprising:

a body having walls defining a volume for holding material to be heated;

a heating element thermally coupled to the body for heating material within the body;

a temperature sensor for sensing temperature of the material;

a shut off switch for shutting off the heater when sensed temperature of the material exceeds a predetermined maximum temperature limit;

detection circuitry including first and second impedance lines coupled to the shut off switch;

a manually actuated reset input for generating a reset signal in response to a manual input to allow the heating element to be turned on; and a controller coupled to the shut off switch and the reset input, wherein the heater is required to be reset by the reset input when an over temperature event is determined, wherein the controller applies a first signal to the first impedance line and monitors a second signal at the second impedance line to determine whether the shut off switch is open, and wherein the controller determines the presence of a false over temperature event and overrides the need to reset the heater during the false over temperature event.

2. The heater as defined in claim 1, wherein the temperature sensor and the shut off switch comprise a thermal switch having an open position and a closed position.

3. The heater as defined in claim 2, wherein the thermal switch comprises a temperature sensitive snap disc.

4. The heater as defined in claim 1, wherein the shut off switch is coupled at one end to an electrical heating element, and at the other end to a ground potential that is a common potential used by the controller.

5. The heater as defined in claim 1, wherein the body comprises an elongated hollow for providing flow-through heating.

6. The heater as defined in claim 1, wherein said heater is a water heater for heating water.

7. The heater as defined in claim 1, wherein the heater further comprises another temperature sensor for sensing temperature of the material, wherein said temperature sensed with said another temperature sensor is used to control the heating element to maintain a selected temperature.

8. The heater as defined in claim 1, wherein the shut off switch is connected in series with the heating element, said controller monitoring a voltage potential at the shut off switch to determine whether a failure has occurred in the heater.

9. The heater as defined in claim 1, wherein the manually actuated reset input comprises a pushbutton switch which generates the reset signal when the pushbutton switch is depressed and released.

10. A water heater having a snap disc temperature sensitive shut off device, said heater comprising:

a body having walls defining a volume for holding water to be heated;

an electric heating element thermally coupled to the body for heating water within the body;

a temperature sensitive switch for sensing temperature of the water and shutting off electrical power to the electric heater when the sensed temperature of the water exceeds a predetermined maximum temperature limit, wherein the temperature sensitive switch is connected in series with the heating element; and a controller for monitoring a voltage potential applied to the temperature sensitive switch, said controller determining whether a failure has occurred in the heater as a function of the monitored voltage potential.

11. The heater as defined in claim 10, wherein the temperature sensitive switch comprises a snap disc thermal switch.

12. The heater as defined in claim 10 further comprising detection circuitry including first and second impedance lines coupled to the snap disc thermal switch, wherein the controller applies a first signal to the first impedance line and monitors a second signal at the second impedance line to determine whether the temperature sensitive switch is open.

13. The heater as defined in claim 10, wherein the temperature sensitive switch is coupled at one end to the electric heating element, and at the other end to a ground potential that is a common potential used by the controller.

14. The heater as defined in claim 10 further comprising a manually actuated reset input for generating a reset signal in response to a manual input to allow the heater element to be turned on.

15. The heater as defined in claim 14, wherein the manually actuated reset input comprises a pushbutton switch that generates the reset signal when the pushbutton switch is depressed and released.

16. The heater as defined in claim 10, wherein the heater further comprises a temperature sensor for sensing temperature of the water, wherein the temperature sensed with the temperature sensor is used to control the heating element to maintain a selected temperature.

17. The heater as defined in claim 10, wherein the heater is employed in a heated water tub.

18. A detection circuit for detecting the state of a temperature sensitive switch for use in a heater, said detection circuit comprising:

a first impedance line coupled to an input of the temperature sensitive switch;

a second impedance line coupled to the input of the temperature sensitive switch; and a controller coupled to the first and second impedance lines, said controller applying a first signal to the first impedance line and monitoring a second signal at the second impedance line, wherein the controller determines if the temperature sensitive switch is open as a function of the second signal.

19. The detection circuit as defined in claim 18, wherein the temperature sensitive switch comprises a snap disc thermal switch.

20. The detection circuit as defined in claim 18, wherein the second signal comprises a voltage signal.

21. The detection circuit as defined in claim 18, wherein the temperature sensitive switch is connected in series to a heating element.

22. The detection circuit as defined in claim 21, wherein the heating element is an electric heating element for heating water.

23. A method for determining the state of a temperature sensitive switch for use in a heater, said method comprising the steps of:

applying a first signal to a first impedance line coupled to an input of a temperature sensitive switch;

sensing a second signal on a second impedance line coupled to the input of the temperature sensitive switch; and determining whether the temperature sensitive switch is open as a function of the second signal.

24. The method as defined in claim 23, wherein the temperature sensitive switch comprises a snap disc thermal switch.

25. The method as defined in claim 23, wherein said step of sensing comprises sensing a voltage signal.

* * * * *